United States Patent [19]

Risei et al.

[11] Patent Number: 4,721,400

[45] Date of Patent: Jan. 26, 1988

[54] HAMMER UNIT FOR PRINTERS

[75] Inventors: Notsu Risei, Yamato; Ooike Hideki, Kawasaki; Kaneko Mitsushiro, Yokohama, all of Japan

[73] Assignee: Fuji System Machines Co., Ltd., Hiburigaoka-Zama, Japan

[21] Appl. No.: 819,815

[22] Filed: Jan. 16, 1986

[51] Int. Cl.[4] ..... B41J 9/133

[52] U.S. Cl. ..... 400/157.1; 400/174; 101/93.48

[58] Field of Search ..... 400/174, 157.1, 157.3, 400/157.2, 175; 101/93.28, 93.29, 93.48

[56] References Cited

U.S. PATENT DOCUMENTS

| | | | |
|---|---|---|---|
| 3,776,341 | 12/1973 | Dohner et al. | 420/157.3 X |
| 4,239,401 | 12/1980 | Veale | 101/93.48 X |

FOREIGN PATENT DOCUMENTS

| | | | |
|---|---|---|---|
| 22340 | 1/1981 | European Pat. Off. | 101/93.48 |
| 86777 | 6/1980 | Japan | 400/157.2 |
| 33157 | 2/1984 | Japan | 400/157.3 |
| 225966 | 12/1984 | Japan | 400/157.3 |

OTHER PUBLICATIONS

IBM Tech. Disc. Bulletin, "Print Hammer Flight Time Transducer", Pennel et al., vol. 22, No. 8B, Jan. 1980, p. 3673.

IBM Tech. Disc. Bulletin, "Energy Compensation for Dot Printers," Helinski et al., vol. 25, No. 7A, Dec. 1982, pp. 3522–3523.

*Primary Examiner*—Charles A. Pearson
*Assistant Examiner*—James R. McDaniel
*Attorney, Agent, or Firm*—Bucknam and Archer

[57] ABSTRACT

This invention provides a hammer unit for use in character printers in which the front end of the plunger of the solenoid operating under control of the print command is positioned directly opposite to and close to the type face of the character head, with the said plunger part being provided with a plunger tip which can be attached to and detached from in a direction perpendicular to the axis of the plunger and which covers the cylindrical face of the plunger and entire circular face of the plunger front end, and with at least the cap part of the plunger tip covering the said front end of the plunger being made of some synthetic resin type material.

According to this invention, when the plunger tip has to be replaced due to wearing out of its cap part, etc., the plunger tip can be replaced easily and quickly by slipping it on and off the plunger along a direction perpendicular to the axis of the plunger. Furthermore, since the print stroke is determined in such a unit by the stroke of the plunger and thickness of the cap part of the plunger tip, the adjustment of the print stroke will be easily done.

1 Claim, 6 Drawing Figures

HAMMER UNIT FOR PRINTERS

BACKGROUND OF THE INVENTION (1) Field of the invention

This invention relates to the print hammer units used in character printers.

(2) Description of the prior art

The conventional fully formed character printers such as MICR or OCR character printers use a hammer unit of the type shown in FIG. 6. Such a hammer unit consists of a hammer part A which is capable of reciprocating linear motion when driven at its rear part in accordance with the print command, a supporting part C with a hole D in it for the plunger to move in, a spring G which is placed within the hole D and which provides the retracting force for the plunger to return to its normal position, and a plunger E whose tip F hits against the character to be printed when driven at its rear part B. Normally, the plunger part E is made of metallic material so as to effectively transmit the impact force from the hammer to the character to be printed. Further, at the front end of the plunger is provided a tip F made of a somewhat resilient material such as nylon resin, stc., so that the ink from the ink ribbon is transferred fully and evenly on to the paper.

Thus, in a conventional hammer unit, the tip F would wear out over long duration of use and hence would need replacement. At the time of such replacement, the conventional unit has many drawbacks as expained below.

Firstly, since the tip F and the plunger E are constructed with an integral structure, the plunger and the tip will both have to be replaced together, thus making it uneconomical.

Secondly, the plunger E is inserted int hole D in the supporting part C which is placed fixedly between the hammer A and the character to be printed. This causes the plunger replacement operation to be unusually complicated because the supporting part C and the hammer A will have to be first detached form the chassis of the unit (not shown in the figure).

Furthermore, since the plunger E is inserted in the hole D along with the spring G, the plunger very often jumps out at the time of its removal due to the force of the spring G, thus cauing additional delays in replacing the plunger.

Finally, in a conventional hammer unit of the above type, the stroke of the plunger has to be adjusted by adjusting the relative positions of the supporting part C and the plunger E and the relative positions of the supporting part C and the hammer A. As a consequence, this adujustment is very cumbersome.

SUMMARY OF THE INVENTION

In view of the above mentioned drawbacks of the conventional hammer units, the present invention aims to provide a hammer unit in wich the operation of replacing a worn out plunger tip can be carried out easily and quickly, the part to be replaced is also limited to only the worn out part, and the adjustment of the print stroke is also made easy.

In order to achieve the above objectives, in a unit accoding to the present invention, the solenoid operating in response to the print command is placed so that the front end of the plunger of the solenoid is close to and directly opposite the type face of the character type head. Also, the said plunger is provided with a cylindrical cover around and in close contact with the periphery of the plunger. Furthermore, the front end of the said cylindrical cover is provided with a cap part that completely covers up the front end of the plunger and hits against the type face at the time of printing. In sucha a hammer tip unit, at least the cap part is made of synthetic resin and is so constructed as to be easily attached to and detached from the plunger.

DETAILED DESCRIPTION

The present invention will be described below using some examples of application shown in the accompanying figures.

Figure 1:
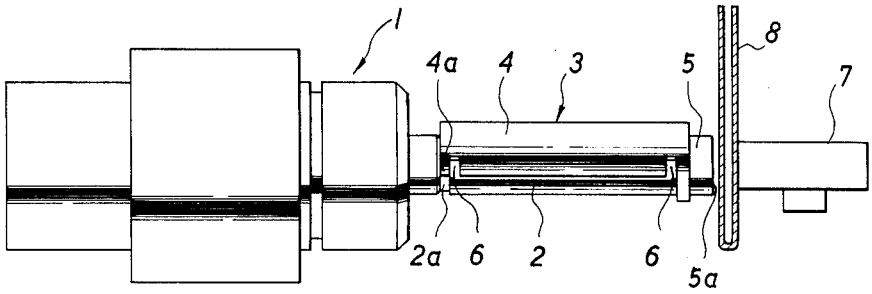
FIG. 1 shows the side view of a unit constructed as one example of application of this invention.
Figure 2:
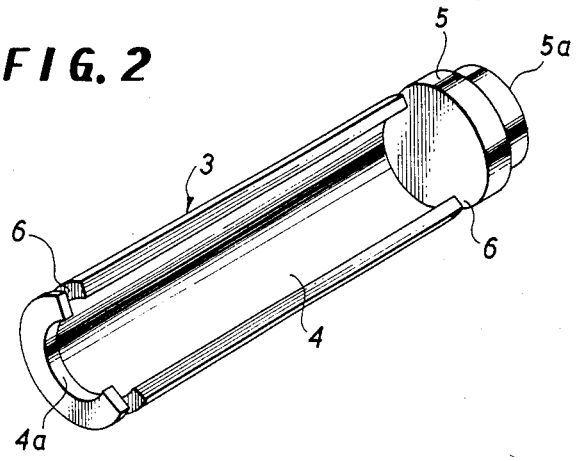
FIG. 2 shows the overall perspective view of the plunger tip part used in the unit of FIG. 1.
Figure 3:
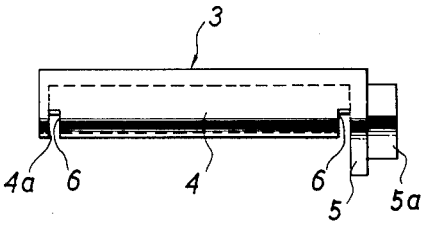
FIG. 3 shows the side view of the plunger tip of FIG. 2.
Figure 4:
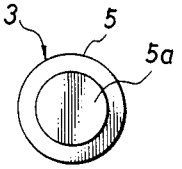
FIG. 4 shows the fornt view of the above plunger tip.
Figure 5:
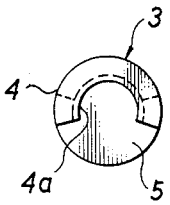
FIG. 5 shows the rear view of the above plunger tip.
Figure 6:
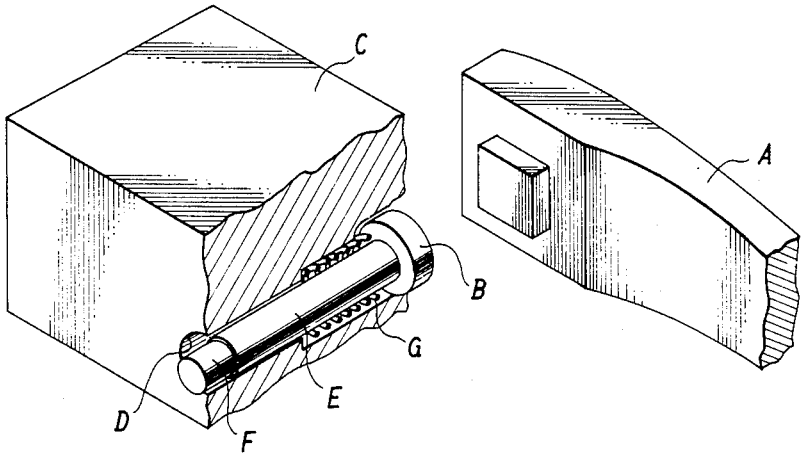
FIG. 6 shows an example of a unit according to the prior art.

FIGS. 1 through 5 show a hammer unit in one example of application of this invention. In FIG. 1, the part marked by the numeral 1 is the solenoid which is placed close to and directly opposite the type face and its plunger 2 moves forward and backward in accordance to the print command. The position of this solenoid 1 is so selected as to ensure that during printing when the plunger moves forward, the cap part 5 of the plunger tip 3 affixed to the plunger as will be described later hits against the type face 7 with an appropriate force. In addition, the position of the solenoid is also such that the front end of the plunger 2 does not come in contact with the type face 7 when the plunger 2 moves forward with the plunger tip 3 not in place. Therefore, the type face 7 will not be damaged by the front end of the plunger 2 when the solenoid 1 is activated inadvertantly with the plunger tip 3 not affixed to the plunger 2.

The part indicated by the numeral 3 is the above mmentioned plunger tip constructed as a single part using some synthetic resin, etc. This plunger tip 3 consists of a body part 4 which has the shape of a hollow cylinder whose internal diameter is almost the same as the external diameter of the plunger 2 of the solinoid 1, and a cap part 5 which is provided at one end of the body part 4. The cap part 5 covers the front end of the plunger 2 and the outer face 5*a* of the cap part hits against the type face 7 during printing. Two grooves 6 and 6 are provided at the two ends of the body part 4 perpendicular to the axis of the body part 4 so that the two ends of the body part 4 an be opened out. Further, the length of the body part 4 is such that the body part can be affixed around the part of the plunger 2 extending beyond the solenoid 1 when the plunger 2 is in the retracted position. Also, the rear end of the body part 4 is provided with an inward projecting part 4*a* which engages with the groove 2*a* provided circumferentially on the periphery of the plunger 2.

The synthetic resin material used for the plunger tip 3 is selected as for conventional hammer tips so that when the plunger tip hits against the type face, it comes into full contact with the entire surface of the type face evenly so that the ink from the ink ribbon, not shown in the figure, gets transferred onto the paper completely and evenly. In order to achieve this objective, the synthetic resin used for the plunger tip 3 should have the appropriate resilience and softness.

The part numbered 7 in the figure is the type face and the part numbered 8 is the paper guide affixed to the chassis of the printer.

Next, the condition of use of the unit will be described below. The plunger tip 3 is held with the fingers at the body part 4 and is positioned above the plunger 2 so that the cap part 5 is coveringa the front end of the plunger 2 and the inward projection 4*a* is in a position to engage with the groove 2*a*. The two open ends of the body part are pressed against the plunger 2 from the above, the lower end of the body part 4 opens out due to this pressure and the plunger tip 3 gets fixed around the plunger and then the lower tip of the body part 4 closes itself around the plunger by its own elastic force. Of course, it is also possible to affix the plunger tip around the plunger 2 as long as it is positioned parallel to the axis of the plunger.

In this condition, if the solenoid is activated due to the print command, the plunger 2 and the plunger tip 3 move forward and the face 5*a* of the cap part 5 of the plunger tip 3 hits against the type face which in turn produces an impression of the type on the paper via the ink ribbon. This process is repeated for printing each new character. However, since the inward projection 4*a* of the plunger tip 3 is engaged with the groove 2*a* of the plunger, the plunger tip will not slip along the axial direction around the plunger and also there will be no fluctuations in the priont stroke. In addition, when the plunger tip 3 impacts against the type face 7, the mass of the plunger too will be effective thereby ensuring that the type face is imparted with sufficient impact energy.

When the plunger tip 3 is to be replaced due to wearing out of the face 5*a* of the cap part 5 or due to some other reason,the plunger tip 3 can be detached from the plunger 2 with a sequence of operations reverse to that described above for affixing the plunger tip around the plunger. In other words, the body part 4 is held with the fingers snd the hammer part is pulled away perpendicular to the axis of the plunger, whereupon the plunger tip 3 gets detached easily from the plunger 2. Therefore, it will be possible to replace only the plunger tip 3 made of synthetic resin and hence the cost of the part being replaced will be much lower than in a conventional unit.

In the example of application of this invention described above, the body part and cap part of the plunger tip were consturucted integrally using some synthetic resin. However, the present invention is not limited to such a structure but can be extended to various other design modifications retaining the spirit of this invention. For example, the body part can be made of a thin metallic material with appropriate springiness while only the cap part is made of some synthetic resein.

In the present invention as described using the above example, the plunger part of the solenoid activated by the print command is provided with a hammer cap which can be easily attached to and detachaed from the plunger along a direction parallel to the diameter of the plunger, with at leaset the cap part of the plunger tip covering the front end of the plunger being made of some synthetic resin so that the face of the cap part hits against the type face. Because of the above feature, when the face of the cap part gets worn out due to repeated impact with the type face, it will be possible to replace only the plunger tip which results in an economical hammer unit. Furthermore, the operation of such plunger tip replacement is also made easy because it is sufficient to slip on and slip of the plunger tip around the plunger along the diametrical direction. In addition, the force of the retractive spring retaining the plunger will not cause any hindrance to the operation of replacing the plunger tip unlike in conventional units, thereby making the replacement operation simple and quick.

Further, according to the present invention, the print stroke is determined by the stroke of the plunger of the solenoid and the thickness of the cap part of the plunger tip whereby the adjustment of the print stroke will become easier as compared with a conventional unit.

What is claimed is:

1. A hammer unit for character printing with character heads which have a type face which comprises a solenoid having a plunger part, the front end of the plunger part being positioned directly opposite to and close to the type face of the character head, said plunger part having a plunger tip which is detachable and attachable to the plunger part in a direction perpendicular to the axis of said plunger part, said plunger tip consisting of a body which encircles the cylindrical side of the plunger part and a cap part which covers the front end of the plunger part and which hits against said type face, at least said cap part of the plunger tip being made of a synthetic resin, wherein said body of said plunger tip has a rear end and a front end, said plunger part has a circumferential groove and said body has an inwardly projecting portion in said rear end, said inwardly projecting portion engaging said groove in said plunger part.

* * * * *